US011208742B2

(12) United States Patent
Jhunjhunwala

(10) Patent No.: US 11,208,742 B2
(45) Date of Patent: Dec. 28, 2021

(54) TEXTILE FABRIC FABRICATED OF TWILL WEAVE SHEETING

(71) Applicant: Sachin Jhunjhunwala, Mumbai (IN)

(72) Inventor: Sachin Jhunjhunwala, Mumbai (IN)

( * ) Notice: Subject to any disclaimer, the term of this patent is extended or adjusted under 35 U.S.C. 154(b) by 0 days.

(21) Appl. No.: 16/816,944

(22) Filed: Mar. 12, 2020

(65) Prior Publication Data

US 2020/0208308 A1 Jul. 2, 2020

Related U.S. Application Data

(63) Continuation-in-part of application No. 15/440,459, filed on Feb. 23, 2017, now Pat. No. 10,689,782.

(30) Foreign Application Priority Data

Dec. 10, 2016 (IN) ..... 201621042256

(51) Int. Cl.

| | |
|---|---|
| ***D03D 1/00*** | (2006.01) |
| ***D03D 13/00*** | (2006.01) |
| ***D03D 15/00*** | (2021.01) |
| *A47G 9/02* | (2006.01) |

(52) U.S. Cl.

CPC ..... *D03D 1/0017* (2013.01); *D03D 13/008* (2013.01); *D03D 15/00* (2013.01); *A47G 9/0207* (2013.01); *A47G 9/0238* (2013.01); *A47G 9/0253* (2013.01); *A47G 9/0261* (2013.01); *A47G 9/0292* (2013.01); *D10B 2201/02* (2013.01); *D10B 2331/04* (2013.01); *D10B 2503/06* (2013.01); *D10B 2503/062* (2013.01)

(58) Field of Classification Search

None

See application file for complete search history.

(56) References Cited

U.S. PATENT DOCUMENTS

| | | | |
|---|---|---|---|
| 2,566,482 | A | 9/1951 | Cohen |
| 4,191,221 | A | 3/1980 | Boyer |
| 5,487,936 | A | 1/1996 | Collier |
| 5,495,874 | A | 3/1996 | Heiman |
| 7,726,348 | B2 | 6/2010 | Heiman |
| 8,186,390 | B2 | 5/2012 | Krishnaswamy et al. |
| 9,131,790 | B2 | 9/2015 | Agarwal |
| 9,474,395 | B2 | 10/2016 | Garg et al. |
| 9,708,736 | B2 | 7/2017 | Agarwal |
| 10,433,159 | B2 | 10/2019 | Agarwal |
| 10,472,744 | B2 | 11/2019 | Agarwal |
| 10,808,337 | B2 | 10/2020 | Agarwal |
| 2001/0033929 | A1 | 10/2001 | Howell et al. |
| 2005/0095939 | A1 | 5/2005 | Heiman |
| 2016/0278551 | A1 | 9/2016 | Garg et al. |
| 2017/0086522 | A1 | 3/2017 | Goenka et al. |
| 2017/0159214 | A1 | 6/2017 | Sundararajan |
| 2018/0080151 | A1 | 3/2018 | Goenka et al. |
| 2018/0163327 | A1* | 6/2018 | Jhunjhunwala ..... D03D 15/00 |

FOREIGN PATENT DOCUMENTS

| | | |
|---|---|---|
| WO | 2017/051396 | 3/2017 |

* cited by examiner

*Primary Examiner* — Shawn Mckinnon

(74) *Attorney, Agent, or Firm* — Wenderoth, Lind & Ponack, L.L.P.

(57) ABSTRACT

The present disclosure relates to a new and improved textile fabric fabricated of twill weave sheeting that has excellent wrinkle resisting characteristics, improved softness and durability over the sheeting fabrics currently being manufactured, enhanced aesthetic appeal, economy in cost of manufacture and other desirable characteristics. The textile fabric of the present disclosure can be formed of warp and weft yarns of twill weave construction wherein each of the warp yarns can be made of a natural material and each of the weft yarns can be made of a synthetic material. In an embodiment, the twill weave sheeting can have warp yarn and weft yarn, wherein the warp yarn and the weft yarn being a cross weave of cotton and polyester.

2 Claims, No Drawings

TEXTILE FABRIC FABRICATED OF TWILL WEAVE SHEETING

CROSS REFERENCE TO RELATED APPLICATIONS

This application is a continuation-in-part application of U.S. application Ser. No. 15/440,459 filed on 23 Feb. 2017, which is a conventional application, claiming benefit of Indian patent application no. 201621042256 filed on 10 Dec. 2016.

FIELD OF THE INVENTION

The present disclosure pertains to technical field of woven fabric material. In particular, the present disclosure pertains to a new and improved textile fabric fabricated of twill weave sheeting having improved wrinkle resisting characteristics, improved softness and durability, and economy in cost of manufacture.

BACKGROUND OF THE INVENTION

The background description includes information that may be useful in understanding the present invention. It is not an admission that any of the information provided herein is prior art or relevant to the presently claimed invention, or that any publication specifically or implicitly referenced is prior art.

Woven sheeting materials or sheeting fabrics are commonly used for pillowcases, bedspread, comforters, towels, blankets, and other related items. Conventionally, sheeting fabrics are often woven with a natural fiber, such as cotton. To enhance the durability of woven sheeting materials, while maintaining the comfort attributable to cotton sheeting, institutions such as hotels, hospitals, rest homes and the like, utilize sheeting materials formed of a blend of natural and synthetic fibres, e.g. a blend of polyester and cotton fibres. Synthetic materials, such as polyester fibres, are usually incorporated in cotton based sheeting materials to minimize the cost and to improve the strength and durability of the sheeting fabric. While the use of polyester fibers significantly increases the durability of the resulting sheet, the comfort level and absorbency of the sheet are significantly affected. Furthermore, sheeting fabrics having substantial amount of synthetic materials tend to become wrinkled or acquire an unpleasant appearance after multiple institutional laundry cycles.

Woven sheeting materials having particular arrangement of warp and weft threads of specific materials are also reported in the art. For example, U.S. Pat. No. 9,474,395 discloses a percale weave sheeting that has warp yarn and weft yarn, the warp yarn and the weft yarn being a cross weave of cotton and polyester. This percale weave sheeting is intended for use as an percale fabric for bedding products, and is characterized by a high thread count of 130 to 1200 threads per square inch, and by a denier of 15 D to 240 D. While satisfying its intended purpose, the physical performance of this percale weave sheeting has been marginal in the area of durability and to some extent the wrinkle resistance characteristics.

There is thus a need in the industry for a new and improved woven sheeting material that has excellent wrinkle resisting characteristics, improved softness and durability over the sheeting fabrics currently being manufactured, economy in cost of manufacture and other desirable characteristics.

The present invention satisfies the existing needs, as well as others, and generally overcomes the deficiencies found in the prior art.

All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability.

OBJECTS OF THE INVENTION

It is an object of the present disclosure to overcome or ameliorate at least one of the disadvantages of the prior art, or to provide a useful alternative.

It is a further object of the present disclosure to provide a new and improved woven sheeting material that has excellent wrinkle resisting characteristics.

It is another object of the present disclosure to provide a woven sheeting material that exhibits increased strength and durability.

It is another object of the present disclosure to provide a woven sheeting material that has a smooth, pleasing surface texture with the natural feel.

It is another object of the present disclosure to provide a new and improved woven sheeting material that can be manufactured in an easy, efficient and cost-effective manner.

It is another object of the present disclosure to provide a new and improved woven sheeting material that has enhanced aesthetic characteristics.

It is yet another object of the present disclosure to provide a new and improved woven sheeting material that can be used in a variety of bedding applications, such as bedsheets, pillowcases, comforters, coverlets, blankets, duvet covers, bedspreads, dust ruffle, pillow sham, and various other applications.

SUMMARY OF THE INVENTION

Aspects of the present disclosure relate to a new and improved textile fabric fabricated of twill weave sheeting that has excellent wrinkle resisting characteristics, improved softness and durability over the sheeting fabrics currently being manufactured, enhanced aesthetic appeal, economy in cost of manufacture and other desirable characteristics. The textile fabric of the present disclosure can be formed of warp and weft yarns of twill weave construction wherein each of the warp yarns can be made of a natural material and each of the weft yarns can be made of a synthetic material.

In an embodiment, the twill weave sheeting can have warp yarn and weft yarn, the warp yarn and the weft yarn being a cross weave of cotton and polyester.

According to one aspect of the present disclosure there is provided a textile fabric fabricated of twill weave sheeting, wherein the twill weave sheeting can include a first surface and a second opposite surface;

wherein the twill weave sheeting can include:

a cotton warp yarn with a yarn count of 20 s to 60 s; and a polyester weft yarn with a denier of 7 D to 240 D and 7 to 216 filament, wherein the cotton warp yarn and the polyester weft yarn in each surface are a cross weave—2 over 1 and under;

wherein both the first and second surfaces comprise a proportion of cotton and a proportion of polyester, the proportion of cotton being greater than the proportion of polyester; and wherein the twill weave sheeting has a high thread count of 200 to 2000 threads per inch thereby exhibiting low pilling.

In an embodiment, the polyester weft yarn has low degree of intermingling of yarns providing improved crispness to the resultant fabric.

In an embodiment, the textile fabric is fabricated of twill weave sheeting, wherein the twill weave sheeting includes a first surface and a second opposite surface;

wherein the twill weave sheeting includes:

a 100% cotton warp yarn with a yarn count of 30 s to 60 s; and a 100% polyester weft yarn with a denier of 7 D to 19 D and 7 to 28 filament, wherein the cotton warp yarn and the polyester weft yarn in each surface are a weave 2 over 1 and under (i.e. a cross weave);

wherein both the first and second surfaces comprise a proportion of cotton and a proportion of polyester, the proportion of cotton being greater than the proportion of polyester; and wherein the twill weave sheeting has a high thread count of 200 to 2000 threads per inch thereby exhibiting low pilling.

In accordance with embodiments of the present disclosure, the disclosed textile fabric fabricated of twill weave sheeting can be used in a variety of bedding applications, such as bedsheets, pillowcases, comforters, coverlets, blankets, duvet covers, bedspreads, dust ruffle, pillow sham, and various other applications.

Various objects, features, aspects and advantages of the inventive subject matter will become more apparent from the following detailed description of preferred embodiments.

DETAILED DESCRIPTION OF THE INVENTION

The following is a detailed description of embodiments of the present disclosure. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the present disclosure as defined by the appended claims.

Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims.

Unless the context requires otherwise, throughout the specification which follow, the word "comprise" and variations thereof, such as, "comprises" and "comprising" are to be construed in an open, inclusive sense that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

In some embodiments, the numbers expressing quantities of ingredients, properties such as concentration, and so forth, used to describe and claim certain embodiments of the invention are to be understood as being modified in some instances by the term "about." Accordingly, in some embodiments, the numerical parameters set forth in the written description are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable.

The recitation of ranges of values herein is merely intended to serve as a shorthand method of referring individually to each separate value falling within the range. Unless otherwise indicated herein, each individual value is incorporated into the specification as if it were individually recited herein.

All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

The headings and abstract of the invention provided herein are for convenience only and do not interpret the scope or meaning of the embodiments.

Various terms are used herein. To the extent a term used in a claim is not defined below, it should be given the broadest definition persons in the pertinent art have given that term as reflected in printed publications and issued patents at the time of filing.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

The present disclosure relates to a textile fabric fabricated of twill weave sheeting that has excellent wrinkle resisting characteristics, improved softness and durability over the sheeting fabrics currently being manufactured, enhanced aesthetic appeal, economy in cost of manufacture and other desirable characteristics.

According to one aspect of the present disclosure there is provided a textile fabric fabricated of twill weave sheeting, wherein the twill weave sheeting can include a first surface and a second opposite surface;

wherein the twill weave sheeting can include:

a cotton warp yarn with a yarn count of 20 s to 60 s; and a polyester weft yarn with a denier of 7 D to 240 D and 7 to 216 filament, wherein the cotton warp yarn and the polyester weft yarn in each surface are a cross weave—2 over 1 and under;

wherein both the first and second surfaces comprise a proportion of cotton and a proportion of polyester, the proportion of cotton being greater than the proportion of polyester; and wherein the twill weave sheeting has a high thread count of 200 to 2000 threads per inch thereby exhibiting low pilling.

In an embodiment, the polyester weft yarn has low degree of intermingling of yarns providing improved crispness to the resultant fabric.

In an embodiment, the textile fabric is fabricated of twill weave sheeting, wherein the twill weave sheeting includes a first surface and a second opposite surface, wherein the twill weave sheeting includes:

a 100% cotton warp yarn with a yarn count of 30 s to 60 s; and a 100% polyester weft yarn with a denier of 7 D to 19 D and 7 to 28 filament, wherein the cotton warp yarn and the polyester weft yarn in each surface are a weave 2 over 1 and under (i.e. a cross weave);

wherein both the first and second surfaces comprise a proportion of cotton and a proportion of polyester, the proportion of cotton being greater than the proportion of polyester; and wherein the twill weave sheeting has a high thread count of 200 to 2000 threads per inch thereby exhibiting low pilling.

In accordance with embodiments of the present disclosure, the disclosed textile fabric fabricated of twill weave sheeting can be used in a variety of bedding applications, such as bedsheets, pillowcases, comforters, coverlets, blankets, duvet covers, bedspreads, dust ruffle, pillow sham, and various other applications.

In accordance with one embodiment of the present disclosure, the textile fabric disclosed herein can be formed of warp and weft yarns of twill weave construction wherein each of the warp yarns can be made of a natural material and each of the weft yarns can be made of a synthetic material.

According to embodiments of the present disclosure, the twill weave sheeting can include a first surface and a second opposite surface, wherein both the first surface and the second surface can exhibit color consistency. Further, both the first surface and the second surface can include a proportion of cotton and a proportion of polyester, wherein the proportion of cotton being greater than the proportion of polyester.

In accordance with embodiments of the present disclosure, the twill weave sheeting can have sheer and heavier areas formed of warp yarn and weft yarn, wherein the warp yarn and the weft yarn being a cross weave of cotton and polyester. In an exemplary embodiment of the present disclosure, the twill weave sheeting can have cotton yarn in a warp direction and polyester yarn in a weft direction. However, the warp yarns and the weft yarns may be interchanged with each other in the weaving, if desired.

In an embodiment of the present disclosure, the twill weave sheeting can include a cotton warp yarn having a count of 20 s to 60 s. Preferably, the cotton yarn can have 20 s to 60 s count made from either carded/combed/compact or Egyptian/pima/supima cotton.

In another embodiment, the cotton warp yarn can be a rich chief value cotton (CVC) with a 51 percent minimum of cotton and a 49 percent maximum of polyester/filament yarn, or polyester spun yarn, or polyester cotton spun yarn.

In an embodiment of the present disclosure, the twill weave sheeting can have a polyester weft yarn with a denier of 7 D to 240 D with 7 filament to 56 filament. In an embodiment, the twill weave sheeting can have a polyester weft yarn with a denier of 7 D to 19 D with 7 filament to 28 filament. In a preferred embodiment, the polyester weft yarn can be a low intermingled polyester filament to provide a twill weave sheeting with improved crispness.

In an embodiment, the disclosed twill weave sheeting can be woven with cotton warp yarns and multi-filament polyester weft yarns to provide a total thread count of from 200 to 2000 threads per square inch, thereby reducing the pilling tendency of the resulting fabric. In some embodiment, the twill weave sheeting can have a weight of 80 to 200 grams per square inch.

In an embodiment of the present disclosure, the twill weave sheeting can be woven with warp cotton yarn made of 100% Cotton/Egyptian cotton/Pima/Supima cotton and weft polyester filament yarn/polyester spun yarn/polyester cotton spun yarn. In the alternative, it can be either way with warp polyester filament yarn/polyester spun yarn/polyester cotton spun yarn and weft cotton yarn made of 100% cotton/Egyptian cotton/Pima/Supima cotton.

According to embodiments of the present disclosure, the cotton warp yarn and the polyester weft yarn in each surface can be in a cross weave, 2/1, 2 over 1 and under. In an alternate embodiment, the cross weave can be 1/2, 1 over and 2 under. In still another embodiment, the cross weave can be 4/, 4 over and 1 under. The woven twill sheeting fabric can have a uniform woven fabric construction of 200 thread count per inch up to 2000 threads per inch throughout both the sheer areas and the heavier areas. Further, the twill weave can have a closed construction and the feel of the resulting sheeting fabric can be homogeneous in both the warp and weft directions because of balanced construction of warp yarns and weft yarns.

In a more preferred embodiments, the cotton warp yarn and the polyester weft yarn in each surface can be in a cross weave, 2/1, 2 over 1 and under.

In an embodiment, the twill weave sheeting can be formed of a single common color, or different colors, or of multiple colors by dyeing the warp and weft yarns with suitable dyes or pigments. Contrasting color dyes can be used for the cotton and polyester fibers to produce a cross-dyed effect. After dyeing, the twill weave sheeting can be finished by conventional methods. Preferably, the polyester yarns may be dyed with disperse dyestuffs, and the cotton yarns may be dyed with reactive dyes suitable to the yarns.

In an illustrative embodiment, the present disclosure provides a textile fabric fabricated of twill weave sheeting, wherein the twill weave sheeting can include a first surface and a second opposite surface, wherein both the first surface and the second surface exhibit color consistency;

wherein the twill weave sheeting can include:

a cotton warp yarn with a yarn count of 20 s to 60 s;

a polyester weft yarn with a denier of 7 D to 240 D and 7 to 28 filament, wherein the polyester weft yarn has low degree of intermingling of yarns, thereby providing improved crispness;

wherein the cotton warp yarn and the polyester weft yarn in each surface are a cross weave, 2 over 1 and under;

wherein both the first and second surfaces comprise a proportion of cotton and a proportion of polyester, the proportion of cotton being greater than the proportion of polyester; and wherein the twill weave sheeting has a high thread count of 200 to 2000 threads per inch thereby exhibiting low pilling.

In accordance with one embodiment of the present disclosure, the textile fabric fabricated of twill weave sheeting can be manufactured into bedding products including, but not limited to, bedsheets, pillowcases, comforters, coverlets, blankets, duvet covers, bedspreads, dust ruffle and pillow sham. Such bedding products can be characterized by a twill weave construction, 2/1, 2 up 1 down, of a high thread count of 200 threads per square inch to 2000 threads per square inch.

According to embodiments, the disclosed twill weave sheeting can combine the comfort features of cotton fibers with the durability advantages of polyester fibers. Further, a textile fabric fabricated of the twill weave sheeting can exhibit enhanced wrinkle resisting properties, and the use of cotton yarns as warp yarns and the inexpensive polyester yarns as weft yarns in the twill weave construction can greatly reduce the overall production cost of the sheeting fabric. Moreover, use of cotton and polyester yarns having the above specified characteristics can significantly improve the strength, durability, dimensional stability, and wash and wear performance of the sheeting fabric.

While the foregoing description discloses various embodiments of the disclosure, other and further embodiments of the invention may be devised without departing from the basic scope of the disclosure. The invention is not limited to the described embodiments, versions or examples, which are included to enable a person having ordinary skill in the art to make and use the invention when combined with information and knowledge available to the person having ordinary skill in the art.

Advantages of the Invention

The present disclosure provides a new and improved textile fabric fabricated of twill weave sheeting that has excellent wrinkle resisting characteristics.

The present disclosure provides a twill weave sheeting material that exhibits increased dimensional strength and durability.

The present disclosure provides a twill weave sheeting material that has a smooth, pleasing surface texture with the natural feel.

The present disclosure provides a twill weave sheeting material that can be manufactured in an easy, efficient and cost-effective manner.

The present disclosure provides a new and improved textile fabric fabricated of twill weave sheeting that has enhanced aesthetic characteristics.

The present disclosure provides a new and improved woven sheeting material that can be used in a variety of bedding applications, such as bedsheets, pillowcases, comforters, coverlets, blankets, duvet covers, bedspreads, dust ruffle, pillow sham, and various other applications.

The invention claimed is:

1. A textile fabric comprising: a twill weave sheeting comprising a first surface and a second opposite surface, wherein the twill weave sheeting comprises:

a 100% cotton warp yarn with a yarn count of 30 s to 60 s;

a 100% polyester weft yarn with a denier of 7 D to 14 D and 7 to 28 filaments;

wherein the cotton warp yarn and the polyester weft yarn in each surface are a weave, 2 over and 1 under;

wherein both the first and second surfaces comprise a proportion of cotton and a proportion of polyester, the proportion of cotton being greater than the proportion of polyester; and wherein the twill weave sheeting has a high thread count of 800 to 2000 threads per square inch.

2. The textile fabric as claimed in claim 1 for use as a bedding product, wherein the bedding product is selected from the group consisting of a bed sheet, a pillow case, a comforter, a coverlet, a pillow sham, a dust ruffle, a blanket, a bedspread, and a duvet cover.

* * * * *